United States Patent [19]

Chambers

[11] 4,187,103

[45] Feb. 5, 1980

[54] TREATED PHOTOCONDUCTIVE TITANIUM DIOXIDE SHEET

[75] Inventor: William L. Chambers, White Bear Lake, Minn.

[73] Assignee: Minnesota Mining and Manufacturing Company, St. Paul, Minn.

[21] Appl. No.: 489,448

[22] Filed: Jul. 17, 1974

Related U.S. Application Data

[60] Division of Ser. No. 867,738, Oct. 20, 1969, Pat. No. 3,859,089, which is a continuation-in-part of Ser. No. 730,225, May 20, 1968, abandoned.

[51] Int. Cl.[2] ..... G03G 5/04; G03G 16/00; G03G 13/24; G03G 13/14

[52] U.S. Cl. ..... 430/40; 430/84

[58] Field of Search ..... 96/1 R, 1.5, 27, 88, 96/1.3, 1.4; 117/17.5; 427/55

[56] References Cited

U.S. PATENT DOCUMENTS

| | | | |
|---|---|---|---|
| 3,197,307 | 7/1965 | Blake et al. | 96/1 R |
| 3,212,890 | 10/1965 | Kimble et al. | 96/1 R |
| 3,245,786 | 4/1966 | Cassiers et al. | 96/1 R |
| 3,563,734 | 2/1971 | Shely | 96/1.4 |

FOREIGN PATENT DOCUMENTS

| | | | |
|---|---|---|---|
| 1456993 | 9/1966 | France | 96/1 R |
| 1128464 | 9/1968 | United Kingdom | 96/1 R |

OTHER PUBLICATIONS

Schaffert, *Electrophotography,* ©1965 , Focal Press Lim., NY; p. 262.

*Primary Examiner*—J. Travis Brown
*Assistant Examiner*—L. Falasco
*Attorney, Agent, or Firm*—C. Alexander; D. M. Sell; D. P. Edmundson

[57] ABSTRACT

A photoconductive copy sheet suitable as an intermediate in an electrographic process, the copy sheet containing photoconductive titanium dioxide and decay retarder in the form of an organic acid or salt thereof. Preferably, the titanium dioxide is of a type having a characteristic relaxation time of less than 9 minutes whereby the copy sheet is capable of producing at least 5 and as many as 100 copies per exposure.

8 Claims, 2 Drawing Figures

TREATED PHOTOCONDUCTIVE TITANIUM DIOXIDE SHEET

Figure 1:
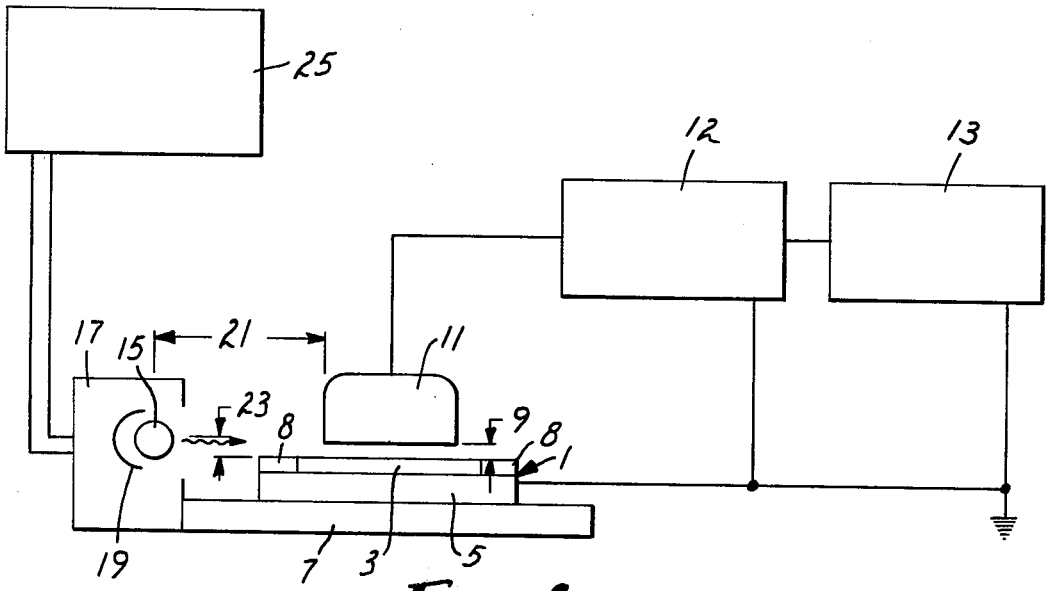

This is a division of copending application Ser. No. 867,738, filed Oct. 20, 1969, now U.S. Pat. No. 3,859,089 which is a continuation-in-part of my copending application Ser. No. 730,225, filed May 20, 1968 now abandoned.

This invention relates to photoconductive sheets and in particular, to photoconductive sheets wherein photoconductive titanium dioxide bears a surface treatment of an organic acid or salt thereof as herein defined. In a preferred embodiment, the photoconductive titanium dioxide is a type which, in combination with such surface treatment, provides photoconductive master or intermediate copysheets from which a surprisingly high number of copies can be produced from one exposure of the master.

There exist several types of electrographic reproducing techniques which utilize a photoconductive surface to produce a latent image corresponding to a light pattern to which the photoconductive surface is exposed. After exposure, the latent image is generally developed with particulate developers to provide the ultimate copy or the intermediate from which the ultimate copy is made by transferring the particulate developer thereto. Exemplary electrographic processes are the electrolytic electrophotographic process described in U.S. Pat. No. 3,010,883, the electrostatic electrophotographic processes such as is illustrated by U.S. Pat. No. 3,152,894, and the dynamic electrographic process described in French Pat. No. 1,456,993. Although the photoconductive copysheet of this invention has general applicability to electrographic processes operating on the above principles, it is particularly adapted as an intermediate for the production of multiple copies in the dynamic electrographic process of said French patent.

In this latter process a photoconductive sheet is used as a field electrode and is exposed to a light image to create a differentially electronically conductive pattern on the field electrode. While the differentially conductive pattern is present in the photoconductive sheet or field electrode, the surface of the field electrode is uniformly contacted with a conductive applicator containing electrically conductive developer or marking material while an electrical field is created by applying a direct current electrical potential between the field electrode and the applicator containing the conductive developer. An electrically conductive path is created between the surface of the field electrode and the applicator. Separation of the developer applicator from the field electrode surface at the end of the development stage is made while the electrical field is maintained. The developer or marking material selectively deposits on the field electrode surface in an image-wise manner corresponding to the original light image, thus providing a visible reproduction. No electrostatic precharging of the field electrode surface is either indicated or desirable. If desired, the developer material may be retained on the field electrode surface or may be transferred to a separate receptor sheet and fixed thereon by chemical or physical means to provide the desired print. The particular advantages of the preferred sheet of this invention, i.e., the ability to retain the latent image throughout plural developments without re-exposure, are of course fully realized when the copysheet serves in the capacity of an intermediate rather than the ultimate copy, although it would serve the latter function as well.

The ability to generate multiple copies from one exposure has been an elusive goal. In the dynamic electrographic process, initial efforts centered on zinc oxide as the photoconductor in the field electrode. To compensate for the inability to produce multiple copies from one exposure, a "bias light" was employed which served to reactivate the photosensitivity of the zinc oxide by exposing the developed field electrode to a controlled amount of light between the development and transfer steps. Only the previously imaged, light struck areas receive this supplemental exposure since the non-light struck areas of the initial exposure are now masked by developer powder. Even so, only four to five faithful copies could be produced per principal exposure. The need for delicate bias light control and the inability to retain low density fine lines despite such control made use of photoconductive zinc oxide undesirable.

Titanium dioxide proved to be similarly incapable of providing multiple copies. Other properties which were lacking in titanium dioxide photoconductive sheets were image quality and humidity resistance. In electrostatic processes, untreated titanium dioxide photoconductive sheets provided image densities on the order of 0.06 to 0.2 o.d.u., values wholly inadequate for general commercial use.

It is thus an object of this invention to provide a photoconductive sheet which will produce copies having good resolution and image density and a relatively clean background.

Another object is to provide a photoconductive sheet capable of producing multiple copies per exposure.

One embodiment of this invention is a photoconductive sheet comprising a base having a coating thereon comprising (1) photoconductive titanium dioxide, (2) an insulating binder providing a matrix for said photoconductive titanium dioxide having an acid number below 70, and (3) from about $0.1\times10^{-6}$ to about $15\times10^{-6}$, preferably $1.5\times10^{-6}$ to $13\times10^{-6}$, equivalents per square meter of total photoconductive titanium dioxide surface of at least one organic acid or organic acid salt having at least 6 carbon atoms per molecule.

In another and preferred embodiment, the invention comprises the above sheet wherein the titanium dioxide has a characteristic relaxation time (CRT) of less than 9 minutes according to the test hereinafter described. Titanium dioxide of this type, referred to as long memory titanium dioxide, will provide as many as 50–150 copies per exposure in the dynamic electrographic process described in the above mentioned French Pat. No. 1,456,993. Just as a significant improvement in multiple copy production is seen between untreated titanium dioxide photoconductive sheets and the organic acid treated titanium dioxide sheets of this invention, there is a further significant improvement between the treated titanium dioxide sheets representing one embodiment of the invention and the treated, long memory titanium dioxide sheets representing another, and preferred, embodiment of this invention.

In specific embodiments of the present invention, the base is a dielectric film alone or in combination with a conductive layer on one face of the dielectric layer, the photoconductive coating being located on the other face.

While it is well known that titanium dioxide exhibits photoconductive properties, it has now been discovered that wide variations exist in the ability of this compound to exhibit long memory photoconductivity.

The memory characteristics of photoconductive $TiO_2$ are determined by the following test.

Test Equipment

Referring to FIG. 1 wherein the test equipment and placement thereof is schematically depicted, a test receptor 1 having a photoconductive layer 3 and a conductive backing 5 is supported on probe base support 7. The photoconductive layer is bordered on two sides by an electrical tape 8 (3M Brand No. 33, 0.008 in. thick). Spaced a distance 9 (0.035 in.) from the surface of photoconductive layer 3 is the sensing probe 11 (Monroe Model 1007B, base 2⅛ inch square) of an electrostatic millivolt meter 12 (Monroe Model 147 Isoprobe Electrostatic Millivoltmeter). A strip chart recorder 13 (Moseley 7100B, manufactured by Hewlett Packard) is connected to the millivolt meter. To the side of the probe 11 is a flash tube 15 (General Electric Model FT-91) housed in a plexiglass chamber 17 containing a parabolic shaped trigger electrode 19. The probe 11 is located a distance 21 (95 mm) from the center of the flashtube. The center of the flashtube is located a vertical distance 23 (1 mm.) from the top of test receptor 1. The flashtube 15 is supplied by power supply 25 (rating of 300 microfared, 900 volts or 122 joules). The illumination from the FT-91 flashtube, triggered at 800 volts, is measured utilizing an IL 600 Photometer, IL 610 Flash Integrator, and a cosine receptor head calibrated at 4000–7000 A°. With the cosine receptor head 12 cm. directly in front of the flashtube and perpendicular to a horizontal plane passing through the center of the flashtube, the energy received by the cosine receptor is $16.8\times10^4$ footcandle - seconds.

Preparation of Test Sample

Seventy-six (76.0) grams of $TiO_2$, 25.3 g. of chlorinated polyethylene binder available under the tradename Tyrin QX 2243.25, 1.90 g. of zinc rosinate (Unirez 1028) and 360 ml. of toluene are dispersed on a ball mill (½ in. diam. glass balls) for a period of 16 hours at 25° C. and then freshly handspread on an aluminum plate 4 in.×4 in.×1/16 in. that has been burnished and then washed in individual solutions of alconox, distilled water, and isopropal alcohol to give a uniform, reproduceable aluminum surface. To maintain a constant wet thickness for all samples, the handspreads are made between two strips of 3M Brand No. 33 electrical tape of 0.008 in. thickness. A straight edge, glided over the strips of tape ensures a uniform surface coating.

Each handspread is made in room light and then placed in darkness to dry. Constant temperature (77° F.) and humidity conditions (26% R.H.) are maintained during all phases of the test. Normal drying time for a hand spread made as described is approximately ½ hour. The dry handspreads are handled only in low intensity, filtered red light until all test operations are completed.

When the dispersion has dried and is ready to be tested, the coated aluminum plate is positioned in the test apparatus as shown in FIG. 1.

Before monitoring the surface potential of a sample, the Monroe must be zeroed on a non-coated aluminum plate. Zeroing refers to adjusting the electrostatic voltmeter to read zero potential on the non-coated aluminum plate. Then, when the coated aluminum plate is placed under the probe, its initial pre-exposure surface potential will represent the effect of the dispersion only. The pre-exposure surface potential should be monitored until the potential is constant for at least one minute.

Figure 2:
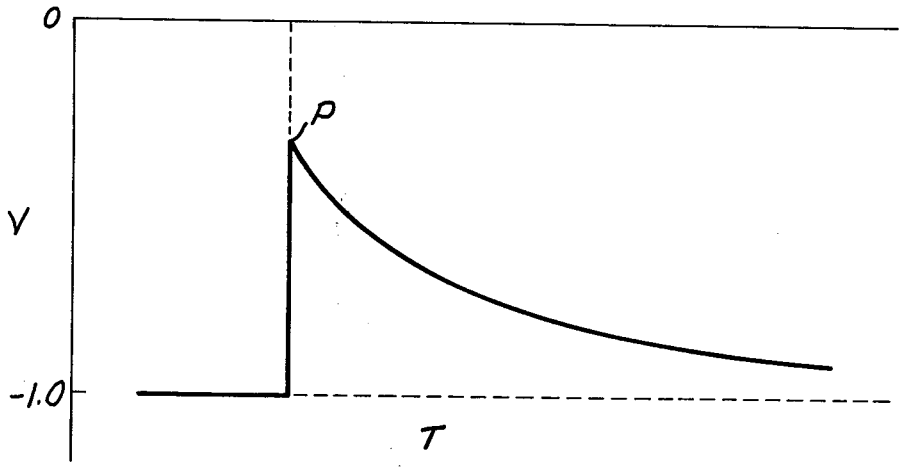

Upon achieving a constant pre-exposure surface potential, the flashtube is triggered at an 800 volt setting of the power supply. Immediately after triggering, an aluminum shield is inserted between the flashtube and probe to eliminate afterglow. As a result of this exposure, there is an instantaneous rise in surface potential to a maximum (photopeak) followed by a relaxation or reduction in surface potential in time. The response of the test sample to exposure is recorded on the strip chart recorder. A typical recording of photoresponse and relaxation is illustrated in FIG. 2 wherein the abscissa is time in minutes (T) and the ordinate is surface potential in volts (V).

Calculations

The surface potential at the photopeak (P) is multiplied by 0.38 or (1/e). The time (in minutes) required for the surface potential to relax to 0.38 of its peak value is recorded. This time is referred to as the characteristic relaxation time (CRT). The titanium dioxide in the test samples having a characteristic relaxation time of less than 9 minutes is considered for purposes of this invention to be long memory titanium dioxide. Thus, the term "long memory titanium dioxide" shall mean titanium dioxide which, when tested as above, will provide test samples exhibiting a characteristic relaxation time of less than 9 minutes, and preferably less than 6 minutes. It is the long memory titanium dioxide which, in combination with the other materials herein described, will enable the production of at least 5 true copies from one exposure according to the dynamic electrographic process generally described in French Pat. No. 1,456,993 and described in detail in the following examples.

In order to achieve the degree of copy multiplication required herein in the preferred embodiment, the photoconductive titanium dioxide must be treated with at least one organic acid or salt thereof. The acids or salts are absorbed onto the titanium dioxide surface. It has been found that such organic acids and salts, including the sulfonic, phosphonic, and carboxylic acids and their salts, serve as decay retarders in the photoconductive layer. Although the actual mechanism is not fully understood, the decay retarders of this invention function independently of the dye sensitizers frequently used. The amount of decay retarder used should not exceed about $15\times10^{-6}$ equivalents per square meter of titanium dioxide surface, preferably ranges from $1.5\times10^{-6}$ to $13\times10^{-6}$, and most preferably from about $6.5\times10^{-9}$ to about $8\times10^{-6}$ equivalents per square meter. Such acids and salts not only provide multiple copy capabilities in conjunction with long memory titanium dioxide, but in addition provide both humidity resistance and improved image quality to all forms of titanium dioxide.

Exemplary organic acids having 6 or more carbon atoms or their salts (e.g., alkali metal, alkaline earth, ammonium, aluminum, gallium, zinc, etc.) include stearic acid, benzoic, oleic acid, cerotic acid, caproic acid, linoleic acid, abietic acid and dehydroabietic acid or their salts. Preferred decay retarders are abietic acid, rosin acid, and their salts. Either saturated or unsaturated acids may be used, with those fatty carboxylic acids having from 6 to 30 carbon atoms (particularly 6 to 20 carbon atoms) being preferred. When used in the above-mentioned concentrations in the dynamic process, such acids decrease the decay rate (defined as the drop in conductivity per unit time after exposure). The effect on decay rate is particularly important because of the time interval between exposure and development encountered in the various electrophotographic processes, the lower decay rates permitting more convenient or effective development without loss in print quality.

The photoconductive titanium dioxide is disposed in an insulating matrix or binder. Certain criteria for binder selection must be followed in the practice of this invention. The effects described require a binder which is free of emulsifying agents and which has an acid number below 70, preferably below 40. The presence of significant amount of emulsifying agents, as commonly used in emulsion polymerization systems, is undesirable. For example, such emulsifying agents tend to cause fog formation and lack of reproducibility. It is therefore desirable to remove them from any emulsion polymers before their use as a binder. Suitable binders may be selected from polymers prepared by solution polymerization (using free radical, ionic or Ziegler type catalysts) or by emulsion polymerization followed by removal of substantially all emulsifying agent. Illustrative polymers prepared by solution polymerization using free radical catalysts are polystyrene, styrene copolymers (e.g., styrene-butadiene copolymer, styrene-n-butyl acrylate copolymer, styrene-isoprene copolymer), acrylonitrile copolymers, polymethyl methacrylate, polybutyl methacrylate, polyhexyl methacrylate, polydimethylaminoethyl methacrylate, polymethyl acrylate, polycyanoethyl acrylate copolymers, and polyvinylidenechloride polymers. Illustrative solution polymers prepared with ionic catalysts include styrene-isoprene copolymers, polyethylene triphenylphosphine, etc. Illustrative solution polymers prepared with the use of Ziegler type catalysts include poly-4-methylpentene, poly-4-methylpentene-1-hexene, etc. The preferred polymers are not reactive with the decay retarders under the coating conditions, and the decay retarders therefore are not chemically bound to the polymer. If polymers derived from emulsion polymerization are used, they must first be treated to remove substantially all emulsifying agent before use in the practice of this invention. Preferred polymeric binders are polystyrene-butadiene copolymers, chlorinated polyethylene, polyvinyl acetate and Lexan polycarbonate.

In order to achieve the desired number of copies from the intermediate photoconductive sheet of this invention, it is a further requirement that the amount of dielectric or insulating material, including binder, on the surface of the sheet be kept to a minimum. Such dielectric materials serve as a blocking layer to the photoconductive coating thereby reducing the multicopy capabilities. If this dielectric surface layer exceeds about 20$\mu$ in thickness, the ability to form the latent image in the form of a differentially conductive pattern close enough to the surface to allow charge exchange with the conductive powder is substantially reduced. Because the photoconductive titanium dioxide is randomly disposed in an insulating binder, the photoconductor will generally not reside at the precise surface of the sheet of course. But it is highly preferred that photoconductor particles be uniformly distributed across the sheet at a depth less than about 5 microns, and preferably less than 1 micron.

The improved photoconductive copysheets may be prepared by conventional technology, such as that described in U.S. Pat. Nos. 3,010,884 and 3,152,894, provided a binder and an organic acid or salt thereof as defined above are combined in the coating dispersion prior to the preparation of the photoconductive layer. Accordingly, the activator may be added to the coating layer just prior to coating or it may be incorporated into the mixture of photoconductive powder and binder before or during the blending or ball milling operation. It is preferred that low volatility solvents having little affinity for the titanium dioxide surface be employed. Such non-wetting solvents include toluene, trichloroethylene, and ethyl acetate.

Various additives, e.g., dye sensitizers, may be added to the coating composition. Their concentration should preferably be below $3\times10^{-3}$ grams of dye per gram of titanium dioxide. The decay retarder has been observed to function independently of dye sensitizers or supersensitizers which may be included in the coating.

For the preferred embodiment herein where the photoconductive sheet is to be employed in the dynamic electrographic process described in French Pat. No. 1,456,993, the base for the photoconductive surface coating comprises a dielectric layer alone or in combination with a conductive layer bonded to the under surface of the dielectric layer. The conductivity of the dielectric layer should be about $10^{-11}$ (ohm-cm.)$^{-1}$ or lower, and preferably $10^{-12}$ or lower, a conductivity fulfilled by most good dielectric or insulating materials. It is preferred that the dielectric layer exhibit such conductivity independent of the ambient conditions, i.e., temperature and relative humidity. In any case, the conductivity of the dielectric layer should be at most about 0.1 of the conductivity of the conductive layer.

A variety of materials satisfy the requirements for the dielectric layer of this invention including polyesters such as that available commercially under the tradename Mylar and Scotchpar, polypropylene, polycarbonate, cellulose acetate, and polystyrene. Polyesters are preferred.

The conductive layer may be supporting or nonsupporting, for example, a thin vapor coated metal layer or a thicker conductive paper support. For the electrographic process of French Pat. No. 1,456,993, the conductivity of this layer should be such that no more than a small voltage drop occurs across it when the developing current passes through it. Small in this sense is relative to the voltage drop in other parts of the circuit through which current passes. Preferably, the voltage drop across the conductive layer should be no more than about 1/10 of the development voltage. Generally, the resistivity of the conductive layer should be less than about $10^{-10}$ ohm-cm., depending upon processing conditions and thickness of the layer. Exemplary conductive materials include conductive paper, paper-metal foil laminates and foils, coatings or other forms of metals such as copper, iron, silver, and aluminum.

The conductive layer may be in the form of a plurality of plies of conductive material or a single layer made from a single material or a mixture of materials.

Photoconductive titanium dioxide powders are commercially available although few have been found to have long memory characteristics as determined by the above-mentioned test. One such long memory photoconductive titanium dioxide is available under the tradename MS 540-5D. Analysis of this material reveals the following:

1. U.V. emission spectrographic analysis (PPM impurities) Fe (15) Pb (40), Sn (15), Mg (3), Cu (1.5), Ag (1.5), Si (3).

2. X-ray diffraction analysis. Anatase form with an excellent X-ray pattern.

3. Surface area determined by BET nitrogen adsorption 20.5 meter$^2$/gram.

4. Analysis for surface treatment with organics. Less than 0.01% C. Negative.

5. Electron microscopic observation. Well formed hexagonal crystallites of 0.05–0.14 micron particle size.

Another suitable long memory titanium dioxide is that prepared according to Example 25 herein.

Particle size is not critical so long as the concentration of decay retarders is maintained at the level specified herein. The titanium dioxide should be present to the extent of from about 40 to about 60, preferably 50 to about 55, volume percent of the total light sensitive layer (binder plus titanium dioxide plus decay retarders, dyes, etc.).

The following examples are provided to illustrate the invention.

EXAMPLES 1–6

A smooth dispersion is prepared by ball milling for 16 hours 76.0 g. of titanium dioxide, 25.3 g. of Tyrin QX 2243.25 (chlorinated polyethylene binder), 1.90 g. zinc rosinate, and 360 ml. toluene. Six lots are prepared, each containing a different titanium dioxide.

Each lot is divided in two, one half being employed in the preparation of a photoconductive sheet for testing in the electrographic process of French Pat. No. 1,456,993, and the other half being tested for characteristic relaxation time according to the above test.

Six photoconductive copy sheets are prepared by applying a uniform coating (about 0.7 mils thick) of the dispersion to a 1 mil thick film of polyethylene terephthalate having a thin vapor deposited aluminum coating on the underside and drying at room temperature. These steps are conducted under safelight conditions.

The photoconductive copy sheets are tested for actual multiple copy production in the following manner. The sheets are exposed to white light through a USAF Resolving Power Test Target fitted with a grey scale and processed by the electrographic process of French Pat. No. 1,456,993 on a duplicating machine described in commonly assigned U.S. Pat. No. 3,706,489 (issued Dec. 19, 1972), filed Apr. 24, 1970 as Ser. No. 31,732, which was a continuation of application Ser. No. 640,547 at the rate of 20 copies per minute with a heat softenable, electrically conductive toner powder at a development voltage of 1500 volts and a transfer voltage of 1000 volts. The development gap is 27 mils; the metering or doctor blade gap is 15 mils. The number of multiple copies provided by each sample is noted in Table 1 below.

The other halves of the original six dispersions are tested for characteristic relaxation time with the results given in Table I.

TABLE I

| Sample | No. Copies/Exposure | CRT (min.) |
|---|---|---|
| 1 | 100 | .7 |
| 2 | 80–100 | 1.1 |
| 3 | 80–100 | 1.25 |
| 4 | 10–15 | 4.2 |
| 5 | 5–7 | 9.0 |

TABLE I-continued

| Sample | No. Copies/Exposure | CRT (min.) |
|---|---|---|
| 6 | 2–3 | 13.3 |

1 National Lead MP 2332-20
2 National Lead MP 2332-24
3 National Lead MS 540-5D
4 Titanium Pigment Corp. MS 300
5 Matheson Coleman & Bell, MCB (CB869) Reagent grade.
6 National Lead MP 2124-1

EXAMPLE 7

A photoconductive sheet is prepared according to Example 3 with the exception that zinc rosinate is eliminated. The sheet tested according to Example 3 under optimum conditions provided 2 to 3 copies per exposure.

EXAMPLES 8–23

Photoconductive copy sheets suitable for purposes of this invention are prepared according to Example 3 with the exception that the zinc rosinate is replaced by similar equivalents per square meter of the following decay retarders:

TABLE II

| EXAMPLE | DECAY RETARDER |
|---|---|
| 8 | benzoic acid |
| 9 | 1-nitroanthraquinone-2-carboxylic acid |
| 10 | stearic acid |
| 11 | oleic acid |
| 12 | diethyl phosphate |
| 13 | 2-naphthalenesulfonic acid |
| 14 | dehydroabietic acid |
| 15 | tetrahydroabietic acid |
| 16 | aluminum rosinate |
| 17 | potassium oleate |
| 18 | sodium stearate |
| 19 | magnesium rosinate |
| 20 | calcium abietate |
| 21 | zinc benzoate |
| 22 | zinc tetrahydrorosinate |
| 23 | cadmium rosinate |

EXAMPLE 24

Smooth dispersions are prepared by ball milling 38.0 g. titanium dioxide (MS 540-5D), 9.5 g. Tyrin QX 2243.25, 150 ml. toluene, 0.025 g. Rhodamine B dye, and zinc rosinate in the amounts noted in Table III below. The dispersions are uniformly applied to a 1 mil. thick polyethylene terephthalate film having a thin vapor deposited aluminum coating on the underside and the coating dried at room temperature under safelight conditions. Each sheet is charged with a corona wand at 6.5 kilovolts and exposed to 10 footcandle seconds of white light through the test target of Examples 1–6. The sheets are developed by contacting with a conductive toner powder to give the results noted in Table III. Above $15\times10^{-6}$ equivalents a noticeable loss in image quality occurs. Below $1.5\times10^{-6}$ equivalents, the image is faint and commercially unacceptable.

TABLE III

| Equivalents per sq./m. $TiO_2$ ($10^{-6}$) | Image Density (o.d.u.) |
|---|---|
| 0 | .06 above fog |
| 1.5 | .5 above fog |
| 3.7 | 1.1 no fog |
| 7.6 | 1.1 no fog |
| 15 | 1.1 no fog |

TABLE III-continued

| Equivalents per sq./m. $TiO_2$ ($10^{-6}$) | Image Density (o.d.u.) |
|---|---|
| 30 | .9 highly fogged |

EXAMPLE 25

The following is a preparation for long memory titanium dioxide. 600 gms. of tetra iso-propyl titanate is added to 1800 cc of distilled water with vigorous agitation. The precipitated hydrous $TiO_2$ is filtered and washed with distilled water to remove the alcohol by-product. The finely powdered $TiO_2$ is dried at 180° F. and bottled. 164 grams is recovered. Firing of the titanium dioxide in air at a temperature between 700° C. and 900° C. yielded long memory titanium dioxide.

Copy sheets of this invention provide excellent image quality, image densities of 1 o.d.u. being attainable. Humidity resistance is also provided. In addition, those copy sheets containing long memory titanium dioxide provide an intermediate which will enable copy multiplication of an order heretofore unobtainable, from 5 to as many as 150. Thus, according to this invention, one is able to ascertain and predict the multicopy capabilities of a particular titanium dioxide sample, and by suitable combination with decay retarders provide an intermediate of multicopy capability.

I claim:

1. A photoconductive sheet comprising a base having a coating thereon comprising (1) photoconductive titanium dioxide having a characteristic relaxation time of less than about 4 minutes and being present to the extent of about 40% to about 60% by volume of said coating;

(2) an insulating binder providing a matrix for said photoconductive titanium dioxide having an acid number below 70; and (3) from about $0.1\times10^{-6}$ to about $15\times10^{-6}$ equivalents per square meter of total photoconductive titanium dioxide surface of at least one organic acid or organic acid salt decay retarder having at least 6 carbon atoms per molecule, said photoconductive sheet being capable of the electrophotographic production of more than about ten copies of substantially similar contrast per exposure to a light image.

2. The photoconductive sheet of claim 1 wherein said decay retarder is zinc rosinate.

3. The photoconductive sheet of claim 1 wherein said binder is a chlorinated polyethylene resin.

4. The photoconductive sheet of claim 1 wherein said decay retarder is present to the extent of from about $1.5\times10^{-6}$ to about $13\times10^{-6}$ equivalents per square meter of total photoconductive titanium dioxide surface.

5. A photoconductive sheet comprising a base having a coating thereon comprising:

(1) titanium dioxide having a characteristic relaxation time of less than about 4 minutes and being present to the extent of from about 40% to about 60% by volume of said coating;

(2) an insulating binder providing a matrix for said titanium dioxide having an acid number below 40; and (3) from about $1.5\times10^{-6}$ to about $15\times10^{-6}$ equivalents per square meter of total titanium dioxide surface of at least one organic acid or organic salt decay retarder having at least 6 carbon atoms per molecule, said photoconductive sheet being capable of the electrophotographic production of more than ten copies of substantially similar contrast per exposure to a light image.

6. The photoconductive sheet of claim 5 wherein said decay retarder is a carboxylic acid or carboxylic acid salt.

7. The photoconductive sheet of claim 5 wherein said base comprises a polyester sheet.

8. The photoconductive sheet of claim 5 wherein said decay retarder is zinc rosinate present to the extent of from about $1.5\times10^{-6}$ to about $13\times10^{-6}$ equivalents per square meter of titanium dioxide surface.

* * * * *